US009672797B2

(12) United States Patent
Ohba et al.

(10) Patent No.: US 9,672,797 B2
(45) Date of Patent: Jun. 6, 2017

(54) SUPPORT ASSEMBLY AND KEYBOARD APPARATUS

(71) Applicant: Yamaha Corporation, Hamamatsu-shi, Shizuoka-ken (JP)

(72) Inventors: Akito Ohba, Hamamatsu (JP); Shunsuke Ichiki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/217,005

(22) Filed: Jul. 22, 2016

(65) Prior Publication Data

US 2017/0025099 A1 Jan. 26, 2017

(30) Foreign Application Priority Data

Jul. 23, 2015 (JP) ..... 2015-145732

(51) Int. Cl.

| | |
|---|---|
| ***G10H 1/32*** | (2006.01) |
| ***G10H 3/00*** | (2006.01) |
| ***G10C 3/16*** | (2006.01) |
| ***G10C 3/22*** | (2006.01) |

(52) U.S. Cl.

CPC ..... *G10C 3/168* (2013.01); *G10C 3/22* (2013.01)

(58) Field of Classification Search

CPC ..... G10C 3/168; G10C 3/22
USPC ..... 84/744, 745, 434
See application file for complete search history.

(56) References Cited

U.S. PATENT DOCUMENTS

| | | | | |
|---|---|---|---|---|
| 2,637,238 | A * | 5/1953 | Murdock | G10C 3/163 84/240 |
| 2,835,157 | A * | 5/1958 | Waters | G10C 3/24 84/240 |
| 5,557,052 | A * | 9/1996 | Hayashida | G10C 3/16 84/221 |
| 6,362,412 | B1 * | 3/2002 | Ura | G10H 1/344 73/488 |
| 6,423,889 | B2 * | 7/2002 | Inoue | G10C 3/22 84/171 |
| 2002/0121183 | A1 * | 9/2002 | Inoue | G10C 5/005 84/719 |
| 2005/0005758 | A1 * | 1/2005 | Yoshisue | G10C 3/22 84/236 |
| 2005/0028665 | A1 * | 2/2005 | Tanaka | G10C 3/24 84/236 |
| 2005/0045016 | A1 * | 3/2005 | Yoshisue | G10C 3/18 84/251 |
| 2008/0307943 | A1 * | 12/2008 | Clark | G10C 3/22 84/239 |

(Continued)

FOREIGN PATENT DOCUMENTS

JP 2005-292361 A 10/2005

*Primary Examiner* — Jeffrey Donels
(74) *Attorney, Agent, or Firm* — Crowell & Moring LLP

(57) ABSTRACT

A support assembly includes a support rotatably disposed with respect to a frame; a jack support portion connected to the support; a jack having a recessed portion in a lower portion of the jack, the jack having the jack support portion inside the recessed portion and being rotatably disposed to the support; and an acting portion fixed to the jack and receiving a downward action. The recessed portion has an open end with a width larger than a width of the jack support portion. The recessed portion may have an open end with a width larger than a width of the jack support portion.

18 Claims, 13 Drawing Sheets

(56) References Cited

U.S. PATENT DOCUMENTS

| | | | | |
|---|---|---|---|---|
| 2009/0173206 | A1* | 7/2009 | Inoue | G10C 3/22<br>84/243 |
| 2014/0013922 | A1* | 1/2014 | Fandrich | G10C 3/161<br>84/242 |

* cited by examiner

SUPPORT ASSEMBLY AND KEYBOARD APPARATUS

CROSS REFERENCE TO RELATED APPLICATIONS

This application is based upon and claims the benefit of priority from the prior Japanese Patent Application No. 2015-145732, filed on Jul. 23, 2015, the entire contents of which are incorporated herein by reference.

FIELD

The present invention relates to a support assembly for use in a keyboard apparatus.

BACKGROUND

Conventional acoustic pianos such as grand pianos and upright pianos are configured of many components. Also, since assembling these components is very complex, the assembling operation takes a long time. In particular, since an action mechanism provided for each key requires many components, its assembling operation is very complex.

For example, in an action mechanism described in Japanese Unexamined Patent Application Publication No. 2005-292361, a plurality of components operate together, and key operation by key pressing and key releasing is transmitted to a hammer. In particular, a support assembly configuring part of the action mechanism operates with various components assembled together. The support assembly has not only a mechanism which achieves string hammering by the hammer in accordance with key pressing but also an escapement mechanism for releasing a force transmitted to the hammer by key operation immediately before string hammering. This mechanism is an important mechanism for the basic operation of an acoustic piano. In particular, in a grand piano, a double escapement mechanism with a repetition lever and a jack combined together is generally adopted.

The operation of the action mechanism provides a sense (hereinafter referred to as a touch feeling) to a finger of a player through the key. In particular, the structure of the support assembly has an important influence on the touch feeling. For example, the touch feeling by the operation of the escapement mechanism is called let-off.

Since the number of respective components making up the support assembly is large, the manufacturing period is prolonged, and manufacturing cost increased. Therefore, to reduce manufacturing cost, it is desired to simply decrease the number of components and the structure. However, if the structure of the support assembly is changed, the touch feeling at the time of key operation is greatly changed. Therefore, it is difficult to decrease the expense of manufacturing an acoustic piano.

SUMMARY

One object of the present invention is to reduce manufacturing cost of a support assembly while decreasing a change in touch feeling at the time of key operation, compared with a keyboard apparatus of an acoustic piano.

A support assembly according to one embodiment of the present invention includes a support rotatably disposed with respect to a frame; a jack support portion connected to the support; a jack having a recessed portion in a lower portion of the jack, the jack having the jack support portion inside the recessed portion and being rotatably disposed to the support; and an acting portion fixed to the jack and receiving a downward action.

The recessed portion may have an open end with a width larger than a width of the jack support portion.

The support assembly may further include a jack pressing portion being contact with the acting portion from above to press the jack downward.

The jack pressing portion may be an elastic member connected to the support.

The jack may include a projecting portion projecting from the jack, and the acting portion may be provided to the projecting portion.

The jack pressing portion may provide a rotating action of the jack to the acting portion.

The jack may have a stopper regulating a rotation range of the jack with respect to the rotating action.

The jack may have a large jack projecting upward and a small jack projecting in a direction opposite to the projecting portion, and the stopper may regulate the rotation range of the jack by abutting on another member on a deeper side from a player of the large jack, above the small jack, or below the projecting portion and a distance from a rotation center of the jack to a position where the stopper abuts on the other member may be farther than a distance from the rotation center of the jack to the acting portion.

A support assembly according to one embodiment of the present invention includes a support rotatably disposed with respect to a frame and having a recessed portion in an upper portion of the support; a jack rotatably disposed to the support; a support connecting portion fixed to the jack, the support connecting portion being disposed inside the recessed portion and including a rotation center of the jack; and an acting portion fixed to the jack and receiving a downward action.

The recessed portion may have an open end with a width larger than a width of the support connecting portion.

REFERENCE SIGNS LIST

Figure 1:
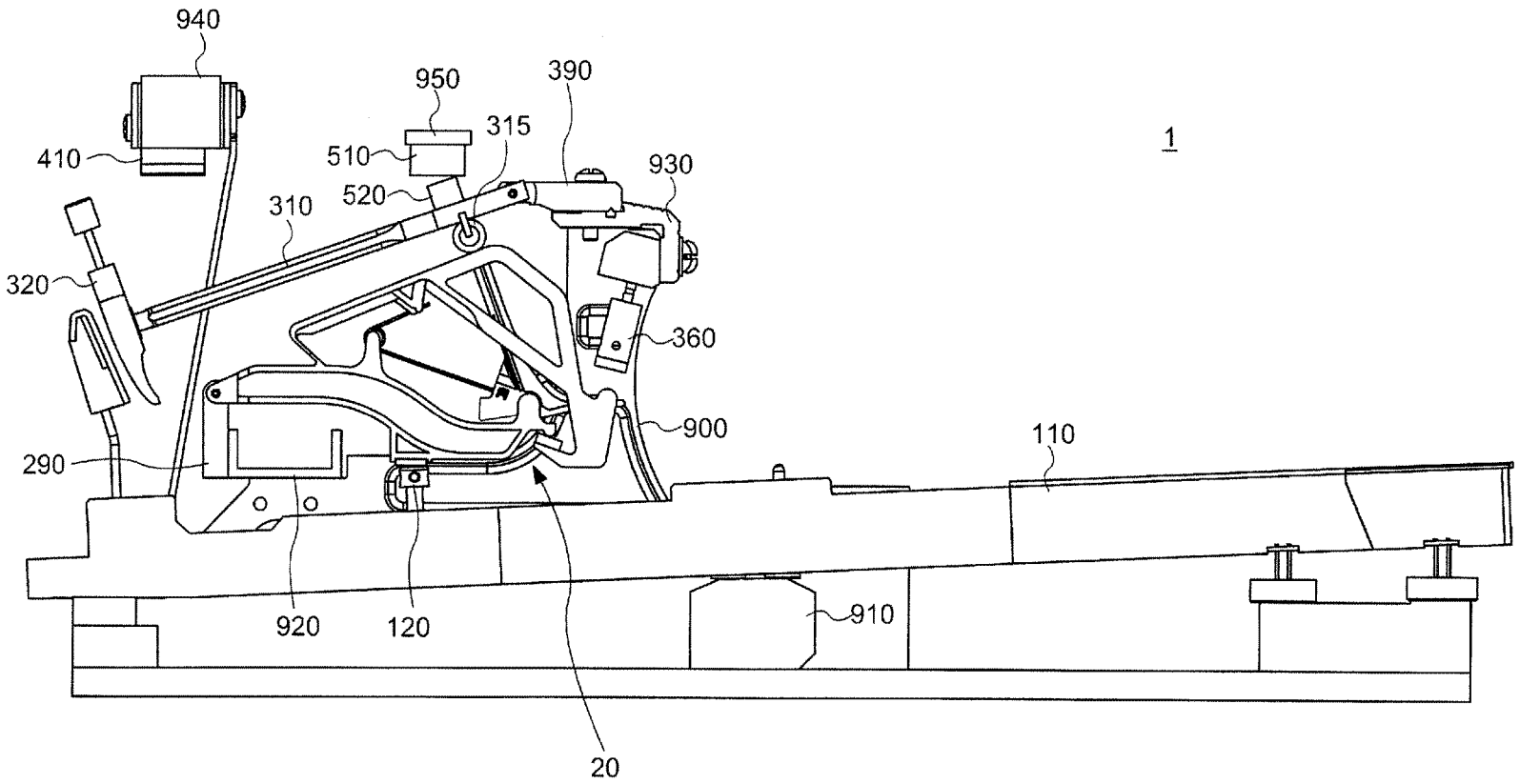
FIG. 1 is a side view depicting the structure of a keyboard apparatus according to one embodiment of the present invention.

1 . . . keyboard apparatus, 20, 60 . . . support assembly, 50 . . . sound emission mechanism, 110 . . . key, 120 . . . capstan screw, 210, 610 . . . support, 212, 612 . . . support heel, 216, 664 . . . stopper, 218 . . . spring support portion, 220, 620, 634 . . . flexible portion, 240, 640 . . . repetition lever, 242 . . . spring contact portion, 244, 644, 662 . . . extension portion, 246 . . . rib, 250, 650 . . . jack, 256 . . . projecting portion, 280 . . . torsion coil spring, 290 . . . support flange, 310 . . . hammer shank, 315 . . . hammer roller, 320 . . . hammer, 346 . . . repetition regulating screw, 360 . . . regulating button, 390 . . . shank flange, 410 . . . hammer stopper, 510 . . . sensor, 520 . . . shielding plate, 550 . . . signal converting unit, 560 . . . sound source unit, 570 . . . output unit, 632 . . . frame fixing portion, 638 . . . mount, 642, 6442, 6444 . . . slit, 648 . . . support fixing portion, 660 . . . operation regulating portion, 666 . . . guide, 674 . . . fixture, 680, 682, 684 . . . coil spring, 900 . . . bracket, 910 . . . balance rail, 920, 960 . . . support rail, 930 . . . shank rail, 940 . . . hammer stopper rail, 950 . . . sensor rail, 2101 . . . first main body portion, 2102 . . . bent portion, 2103 . . . second main body portion, 2105, 6105 . . . jack support portion, 2106, 6106 . . . recessed portion, 2109 . . . through hole, 2110 . . . jack rotation shaft, 2112, 2512 . . . coupling portion, 2114 . . . protruding portion, 2441 . . . inner portion, 2442 . . . outer portion, 2443 . . . coupling portion, 2444 . . . stopper contact portion, 2502, 6502 . . . large jack, 2504, 6504 . . . small jack, 2505, 6505 . . . support connecting portion, 2506, 6506 . . . recessed portion, 2510 . . . jack rotation shaft, 2562, 6562 . . . spring contact portion, 2564, 6564 . . . jack rotation stopper, 2802 . . . first arm, 2804 . . . second arm, 2806 . . . coil, 6382 . . . large-jack stopper, P1, P2 . . . protrusion

DESCRIPTION OF EMBODIMENTS

In the following, a keyboard apparatus including a support assembly in one embodiment of the present invention is described in detail with reference to the drawings. Embodiments described below are merely examples of embodiments of the present invention, and the present invention should not be interpreted to be restricted to these embodiments. Note that, in the drawings referred to in the present embodiments, identical portions or portions having a similar function are provided with a same sign or similar sign (sign with a numeral merely followed by A, B, or the like), and repetitive description thereof may be omitted. Also, for convenience of description, the dimensional ratios in the drawings (such as ratio between respective structures, or a ratio among length) may differ from an actual ratio, and part of the structure may be omitted from the drawings.

First Embodiment

Structure of Keyboard Apparatus 1

A keyboard apparatus 1 in one embodiment of the present invention is an example obtained by applying one example of the support assembly according to the present invention to an electronic piano. To obtain a touch feeling close to a grand piano at the time of key operation, this electronic piano includes a structure similar to a support assembly included in a grand piano. By using FIG. 1, a general outline of the keyboard apparatus 1 according to one embodiment of the present invention is described.

FIG. 1 is a side view depicting a mechanical structure of the keyboard apparatus according to one embodiment of the present invention. As depicted in FIG. 1, the keyboard apparatus 1 according to one embodiment of the present invention includes a plurality of keys 110 (in this example, eighty-eight keys) and an action mechanism for each of the keys 110. The action mechanism includes a support assembly 20, a hammer shank 310, a hammer 320, and a hammer stopper 410. Note that while FIG. 1 depicts the case in which the key 110 is a white key, the key may be a black key. Also, in the following description, terms representing orientations such as a forward side, a deeper side, upward, downward, and sideward from a player are defined as orientations when the keyboard apparatus is viewed from a player's side. For example, in the example of FIG. 1, the support assembly 20 is disposed on a forward side from a player when viewed from the hammer 320, and is disposed upward when viewed from the key 110. Sideward corresponds to a direction in which the keys 110 are arranged.

The key 110 is rotatably supported by a balance rail 910. The key 110 rotates in a range from a rest position depicted in FIG. 1 to an end position. Here, the "rest position" refers to a key position in a non-pressed state, and the "end position" refers to a key position in a state in which the key is fully pressed. The key 110 includes a capstan screw 120. The support assembly 20 is rotatably connected to a support flange 290, and is resting on the capstan screw 120. The support flange 290 is fixed to a support rail 920. Detailed structure of the support assembly 20 will be described further below. Note that the support flange 290 and the support rail 920 are one example of a frame serving as a reference of rotation of the support assembly 20. The frame may be formed of a plurality of members, such as the support flange 290 and the support rail 920, or may be formed of one member. The frame may be, as with the support rail 920, a rail-shaped member with a long side in the arrangement direction of the keys 110, or may be, as with the support flange 290, an independent member for each key 110.

The hammer shank 310 is rotatably connected to a shank flange 390. The hammer shank 310 includes a hammer roller 315. The hammer shank 310 is mounted on the support assembly 20 via the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940 disposed at a position of regulating rotation of the hammer shank 310.

A sensor 510 is a sensor for measuring the position and moving speed (speed immediately before the hammer shank 310 collides with the hammer stopper 410) of the hammer shank 310. The sensor 510 is fixed to a sensor rail 950. In this example, the sensor 510 is a photo interrupter. In accordance with the amount of shielding the optical axis of the photo interrupter by a shielding plate 520 fixed to the hammer shank 310, an output value from the sensor 510 is changed. Based on this output value, the position and moving speed of the hammer shank 310 can be measured. Note that a sensor for measuring an operating state of the key 110 may be provided in place of the sensor 510 or together with the sensor 510.

The above-described support rail 920, shank rail 930, hammer stopper rail 940, and sensor rail 950 are supported by a bracket 900.

[Structure of Support Assembly 20]

Figure 2:
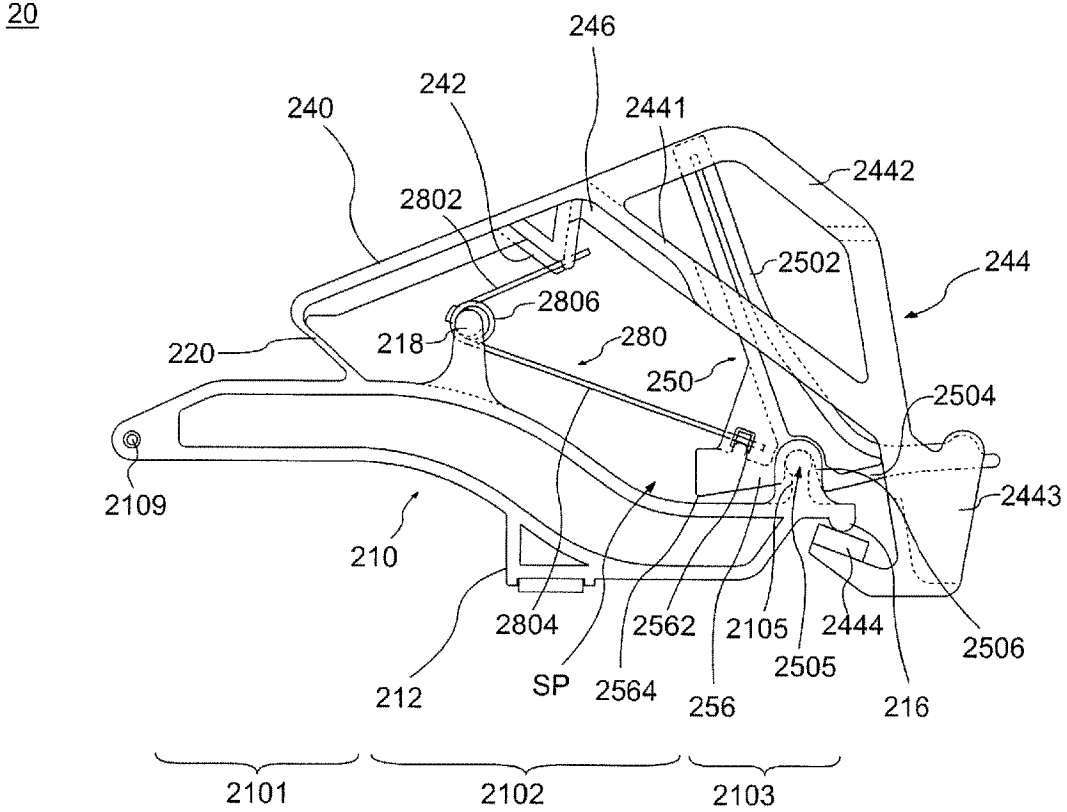
FIG. 2 is a side view depicting the structure of a support assembly according to one embodiment of the present invention.

FIG. 2 is a side view depicting the structure of the support assembly in one embodiment of the present invention. The support assembly 20 includes a support 210, a repetition lever 240, the jack 250, and the torsion coil spring 280. The support 210 and the repetition lever 240 are coupled together via a flexible portion 220. By the flexible portion 220, the repetition lever 240 is rotatably supported with respect to the support 210. The support assembly 20, except the torsion coil spring 280 and cushioning materials or the like (such as nonwoven fabric or elastic body) provided at a portion which collides with another member, is a resin-made structure manufactured by injection molding. In this example, the support 210 and the repetition lever 240 are integrally formed. Note that the support 210 and the repetition lever 240 may be formed as individual components and be attached or bonded together.

The support 210 has one end side where a through hole 2109 is formed, and has the other end side where a jack support portion 2105 projecting upward from the support 210 is formed. Between the through hole 2109 and the jack support portion 2105, the support 210 includes a support heel 212 projecting downward and a spring support portion 218 projecting upward. Through the through hole 2109, a shaft supported by the support flange 290 is drawn. With this, the support 210 is rotatably disposed with respect to the support flange 290 and the support rail 920. The support heel 212 has a lower surface in contact with the above-described capstan screw 120. The spring support portion 218 supports the torsion coil spring 280. The jack support portion 2105 rotatably supports the jack 250.

Between the through hole 2109 and the jack support portion 2105, a space SP is formed on a jack support portion 2105 side from the support heel 212. For convenience of description, the support 210 is sectioned into regions: a first main body portion 2101, a bent portion 2102, and a second main body portion 2103, from a through hole 2109 side. In this case, by the bent portion 2102 which couples the first main body portion 2101 and the second main body portion 2103 together, the second main body portion 2103 is disposed on a side closer to the key 110 (downward) than the first main body portion 2101. The jack support portion 2105 projects upward from the second main body portion 2103. According to this sectioning, the above-described space SP corresponds to a region interposed between the bent portion 2102 and the jack support portion 2105 above the second main body portion 2103. Also, a stopper 216 is coupled at an end of the support 210 (an end on a second main body portion 2103 side). The structure of the jack support portion 2105 supporting the jack 250 will be described in detail further below.

To the repetition lever 240, a spring contact portion 242 and an extension portion 244 are coupled. The spring contact portion 242 and the extension portion 244 extend from the repetition lever 240 to a support 210 side. The spring contact portion 242 makes contact with a first arm 2802 of the torsion coil spring 280. The repetition lever 240 and the extension portion 244 include two plate-shaped members for interposition from sides of both side surfaces of the jack 250. In this example, the extension portion 244 and the jack 250 slidably make contact with each other in at least part of a space interposed between these two plate-shaped members.

The extension portion 244 includes an inner portion 2441, an outer portion 2442, a coupling portion 2443, and a stopper contact portion 2444. The inner portion 2441 is coupled in the repetition lever 240 on a deeper side from a player (flexible portion 220 side) of a large jack 2502. At a portion where the inner portion 2441 and the repetition lever 240 are coupled together, a rib 246 is provided. The inner portion 2441 interposes the large jack 2502 to cross the large jack 2502 to extend to a forward side from a player (opposite side to the flexible portion 220) of the large jack 2502. That is, it can also be said that the extension portion 244 crosses the jack 250. At a portion of the intersection between the inner portion 2441 and the large jack 2502, one or both of the inner portion 2441 and the large jack 2502 may be provided with a protrusion which decreases a contact area of both of them. The protrusion may be in a dot shape or linear shape.

The outer portion 2442 is coupled to the repetition lever 240 on a forward side from a player (opposite side to the flexible portion 220) of the jack 250 (large jack 2502). The inner portion 2441 and the outer portion 2442 are coupled together at the coupling portion 2443. The coupling portion 2443 interposes a small jack 2504 from both side surfaces. Here, between the coupling portion 2443 and the small jack 2504, one or both of the coupling portion 2443 and the small jack 2504 may be provided with a protrusion which decreases a contact area of both of them. The protrusion may be in a dot shape or linear shape.

The stopper contact portion 2444 is coupled to the coupling portion 2443, and makes contact with the stopper 216 from downward of the stopper 216. That is, the stopper 216 regulates a rotation range of the repetition lever 240 to a direction in which a distance between the repetition lever 240 and the support 210 spreads (upward). In other words, the extension portion 244 is connected to the repetition lever 240 on a jack 250 side from the rotation center of the repetition lever 240 and makes contact with the stopper 216 from downward of the stopper 216. Here, the stopper 216 is connected to the support 210 below the rotation center of the jack 250.

The jack 250 includes the large jack 2502, the small jack 2504, and a projecting portion 256. The large jack 2502 projects upward, and the small jack 2504 projects to the forward side from a player. The jack 250 is rotatably disposed with respect to the support 210. Between the large jack 2502 and the small jack 2504, a support connecting portion 2505 to be rotatably supported by the jack support portion 2105 is formed. The support connecting portion 2505 has a recessed portion 2506 in a lower portion (support 210 side or key 110 side) of the jack 250. Inside the recessed portion 2506, the jack support portion 2105 is disposed.

The shape of the support connecting portion 2505 allows the jack 250 to fit into the jack support portion 2105 from above the jack support portion 2105. The projecting portion 256 projects from the large jack 2502 to a side opposite to the small jack 2504 and rotates with the jack 250. The projecting portion 256 includes, on its side surface, a spring contact portion 2562, and also includes, at its end opposite to the small jack 2504, a jack rotation stopper 2564.

The spring contact portion 2562 makes contact with a second arm 2804 of the torsion coil spring 280 to receive a downward action from the second arm 2804. In other words, the second arm 2804 makes contact with the spring contact portion 2562 from above, to press the jack 250 downward. Furthermore, in other words, the second arm 2804 provides a rotating action of the jack 250 to the spring contact portion 2562. Here, the spring contact portion 2562 can be said as an acting portion. Also, the second arm 2804 or the torsion coil spring 280 can be said as a jack pressing portion. The jack rotation stopper 2564 makes contact with the support 210 from above to regulate a rotation range of the jack 250 with respect to the rotating action in a direction in which the large jack 2502 approaches the repetition lever 240.

The torsion coil spring 280 has the stick-shaped first arm 2802, the stick-shaped second arm 2804, and a coil 2806. The coil 2806 has an annular shape, is supported by the spring support portion 218, and makes contact with the spring support portion 218 at a fulcrum inside the coil 2806. The first arm 2802 functions as an elastic body which provides a rotational force to the repetition lever 240 so as to make contact with the spring contact portion 242 to move a player's side of the repetition lever 240 upward (in a direction away from the support 210). The second arm 2804 functions as an elastic body which provides a rotational force to the jack 250 so as to make contact with the spring contact portion 2562 to move the projecting portion 256 downward (in a direction of approaching the support 210). The above is description of the structure of the support assembly 20.

[Structure of Jack Support Portion 2105 and Support Connecting Portion 2505]

Figure 3B:
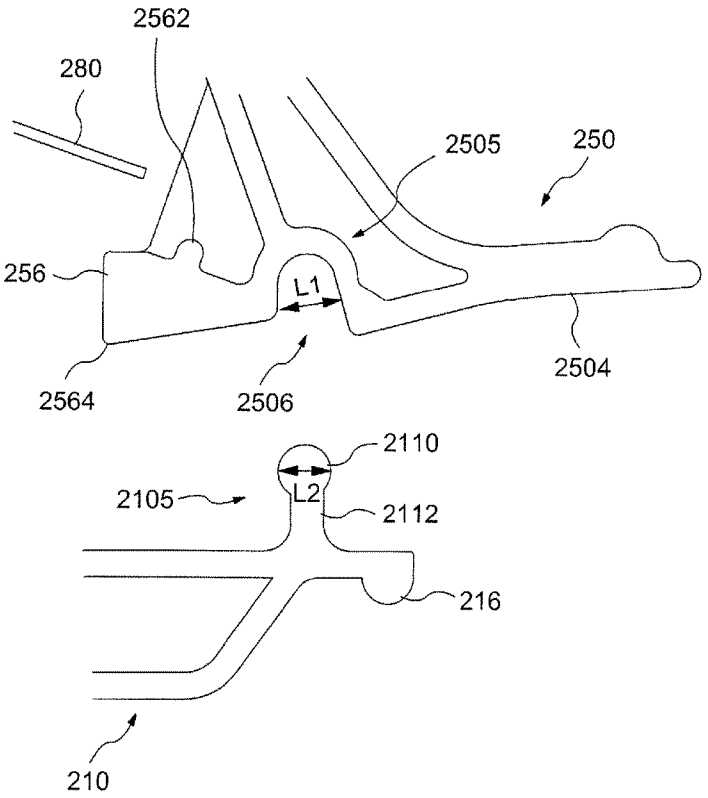
FIG. 3B is a disassembled view of the enlarged side view of the jack support portion in the support assembly according to one embodiment of the present invention.
Figure 3A:
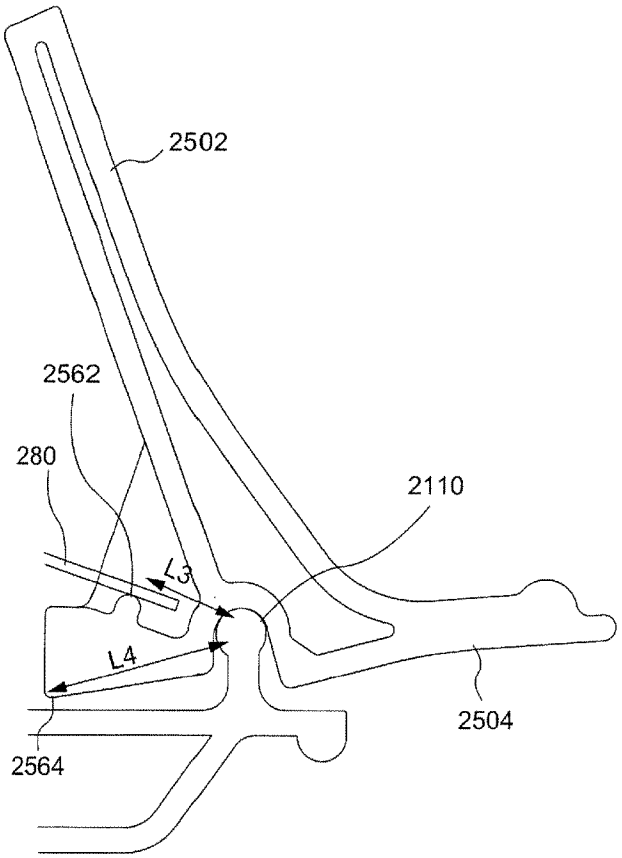
FIG. 3A is an enlarged side view of a jack support portion in the support assembly according to one embodiment of the present invention.

The structure of the jack support portion 2105 and the support connecting portion 2505 is described in detail by using FIG. 3A and FIG. 3B. FIG. 3A is an enlarged side view of the jack support portion in the support assembly according to one embodiment of the present invention. FIG. 3B is a disassembled view of the enlarged side view of the jack support portion in the support assembly according to one embodiment of the present invention. Here, FIG. 3A is a side view when the support connecting portion 2505 engages with the jack support portion 2105. FIG. 3B is a side view when the support connecting portion 2505 and the torsion coil spring 280 (only the second arm 2804 is depicted in FIG. 3A and FIG. 3B) are removed from the jack support portion 2105. Note that a cover member and so forth disposed sideward of the jack 250 and the torsion coil spring 280 are omitted in the side views depicted in FIG. 3A and FIG. 3B for convenience of description.

As depicted in FIG. 3A and FIG. 3B, the jack support portion 2105 includes a jack rotation shaft 2110 and a coupling portion 2112. The coupling portion 2112 couples the jack rotation shaft 2110 and the support 210. The jack rotation shaft 2110 has an upper end in an arc shape. The recessed portion 2506 provided to the support connecting portion 2505 has an arc shape on an upper surface portion of the recessed portion 2506 in an arc shape corresponding to the arc shape of the jack rotation shaft 2110. The arc of the recessed portion 2506 has a radius of curvature larger than the radius of curvature of the jack rotation shaft 2110. Here, when the upper end of the jack rotation shaft 2110 and the upper surface portion of the recessed portion 2506 each have not an arc shape but an oval shape or curved shape, the radiuses of curvature of both of these at a contact point of the jack rotation shaft 2110 and the upper surface portion of the recessed portion 2506 may be designed so as to satisfy the above-described conditions. As depicted in FIG. 3A, with the recessed portion 2506 engaging with the jack rotation shaft 2110, the jack 250 rotates about the jack rotation shaft 2110.

Here, a width L1 near an open end of the recessed portion 2506 is larger than a width L2 of the jack rotation shaft 2110. That is, when the jack 250 is removed from the support 210, the recessed portion 2506 does not catch the jack rotation shaft 2110, and therefore the support connecting portion 2505 can be smoothly removed from the jack support portion 2105. While the structure is illustrated in FIG. 3A and FIG. 3B in which the width L1 is larger than the width L2, the present embodiment is not restricted to this structure, and the width L1 may be smaller than the width L2. That is, when the jack 250 is removed from the support 210, the support connecting portion 2505 may catch the jack support portion 2105. In other words, the jack 250 may be connected to the support 210 in a snap-fit manner.

While the structure is illustrated in FIG. 3A and FIG. 3B in which the recessed portion 2506 has an open end with the width L1 in a radial direction of the jack rotation shaft 2110 (or longitudinal direction of the key 110) and the jack rotation shaft 2110 has a diameter with the width L2 in the above-mentioned radial direction, the present embodiment is not restricted to this structure. For example, the structure may be such that the recessed portion has an open end with the width L1 in a direction of the axis of the jack rotation shaft 2110 (or arrangement direction of the keys 110) and the jack rotation shaft 2110 has a diameter with the width L2 in the above-mentioned axial direction. The structure may also be such that the recessed portion 2506 has an open end with the width L1 in a radial direction and axial direction of the jack rotation shaft 2110 and the jack rotation shaft 2110 has a diameter with the width L2 in the radial direction and axial direction of the jack rotation shaft 2110. That is, the open end of the recessed portion 2506 may have a circular shape, and the jack rotation shaft 2110 may have a globular shape. Here, the open end of the recessed portion 2506 may have an oval shape, and the jack rotation shaft 2110 may have a spheroid.

As depicted in FIG. 3A, a distance L4 between the jack rotation shaft 2110 and the jack rotation stopper 2564 is longer than a distance L3 between the jack rotation shaft 2110 and the spring contact portion 2562. Here, the distance L3 may be a distance from the rotation center of the jack 250 to the spring contact portion 2562, and the distance L4 may be a distance from the rotation center of the jack 250 to the jack rotation stopper 2564. In other words, it can be said that the jack rotation stopper 2564 is provided at a position at a distance from the rotation center of the jack 250 farther than a distance of the spring contact portion 2562 therefrom. With the above-described structure, the jack 250 is rotated by a downward action received by the spring contact portion 2562 from the second arm 2804 to cause the jack rotation stopper 2564 to make contact with the support 210. In this state, the jack 250 presses the jack rotation shaft 2110 downward by the recessed portion 2506. Note that when the rotation stopper is provided to a deeper side from a player of the large jack 2502 or above the small jack 2504, with the stopper making contact with another member, the jack 250 presses the jack rotation shaft 2110 downward by the recessed portion 2506. In this manner, the recessed portion 2506 engages with the jack rotation shaft 2110.

Figure 3C:
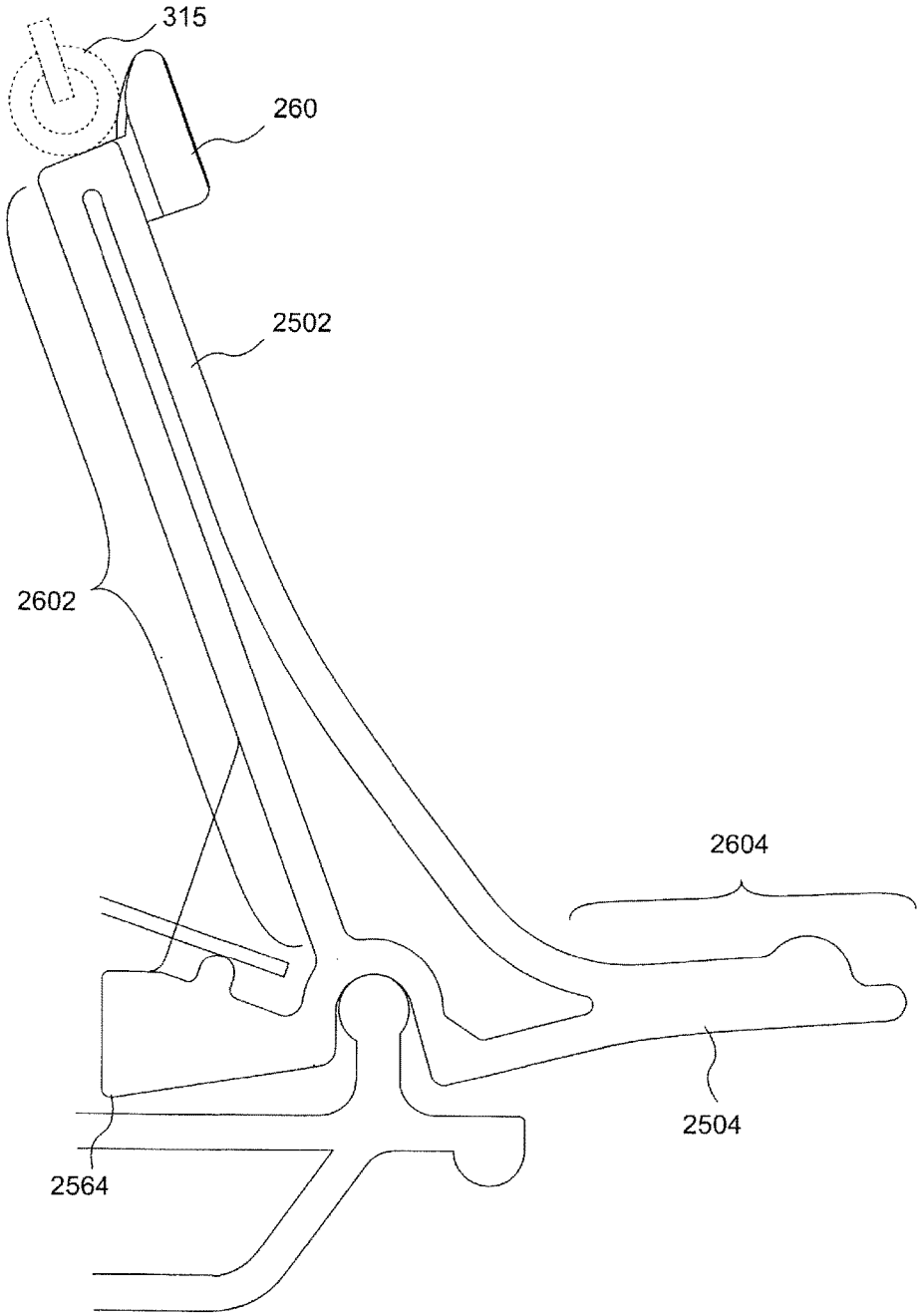
FIG. 3C is an enlarged side view of a jack in the support assembly according to a modification example of one embodiment of the present invention.

While the structure is illustrated in FIG. 3A and FIG. 3B in which the jack rotation stopper 2564 is provided at a lower portion of the projecting portion 236, the present embodiment is not restricted to this structure. For example, as depicted in FIG. 3C, the large jack 2502 may include the jack rotation stopper 260 projecting upward from the large jack 2502. FIG. 3C is an enlarged side view of a jack in the support assembly according to a modification example of one embodiment of the present invention. The jack rotation stopper 260 regulates the rotation range of the jack 250 by making contact with the hammer roller 315 in a rest state. Since the jack rotation stopper 260 is included in the large jack 2502, the state of FIG. 3C can be said such that the large jack 2502 abuts on the hammer roller 315 on the deeper side from a player of the large jack 2502. Also, in place of the jack rotation stopper 260 depicted in FIG. 3C, the large jack 2502 or the small jack 2504 may function as a rotation stopper of the jack 250. That is, the rotation range of the jack 250 may be regulated by bringing a portion (reference numeral 2602) on the deeper side from a player of the large jack 2502 or an upper portion (reference numeral 2604) of the small jack 2504 into contact with a member fixed to the repetition lever 240, the extension portion 244, or the support 210.

As described above, according to the keyboard apparatus 1 of the first embodiment of the present invention, the number of components configuring the support assembly can be decreased while the operation of the support assembly is ensured equivalently to conventional ones. Therefore, double escapement can be achieved in a simpler structure compared with the support assembly for use in general grand pianos, and thus the manufacturing cost can be reduced while an influence on touch feeling is decreased.

Also, with the recessed portion 2506 engaging with the jack rotation shaft 2110, the jack 250 is attached to the support 210, and the support assembly 20 is assembled easily. Furthermore, with the jack 250 pressed downward, the jack 250 is inhibited from being detached from the support 210. Still further, since the width L1 of the open end of the recessed portion 2506 is larger than the width L2 of the jack rotation shaft 2110, attachment and removal of the jack 250 to and from the support 210 are further facilitated.

With the projecting portion 256 provided to the jack, flexibility of designing the spring contact portion 2562 and the jack rotation stopper 2564 is improved. Also, with the jack rotation stopper 2564 provided to the jack 250, the rotation range of the jack 250 is regulated, and stable operation of the support assembly 20 can be obtained. Furthermore, the distance between the jack rotation stopper 2564 and the rotation center of the jack 250 is longer than the distance between the spring contact portion 2562 and the rotation center of the jack 250. With this, even if the rotation of the jack 250 is regulated by the jack rotation stopper 2564, the rotation center of the jack 250 is inhibited from moving from the jack rotation shaft 2110 to another place. That is, even in the above-described state, the upper surface of the recessed portion 2506 presses the jack rotation shaft 2110 downward, and therefore the jack 250 is prevented from being detached from the support 210.

[Operation of Support Assembly 20]

Next, the support assembly 20 is described when the key 110 is pressed down from the rest position (FIG. 1) to the end position.

Figure 4:
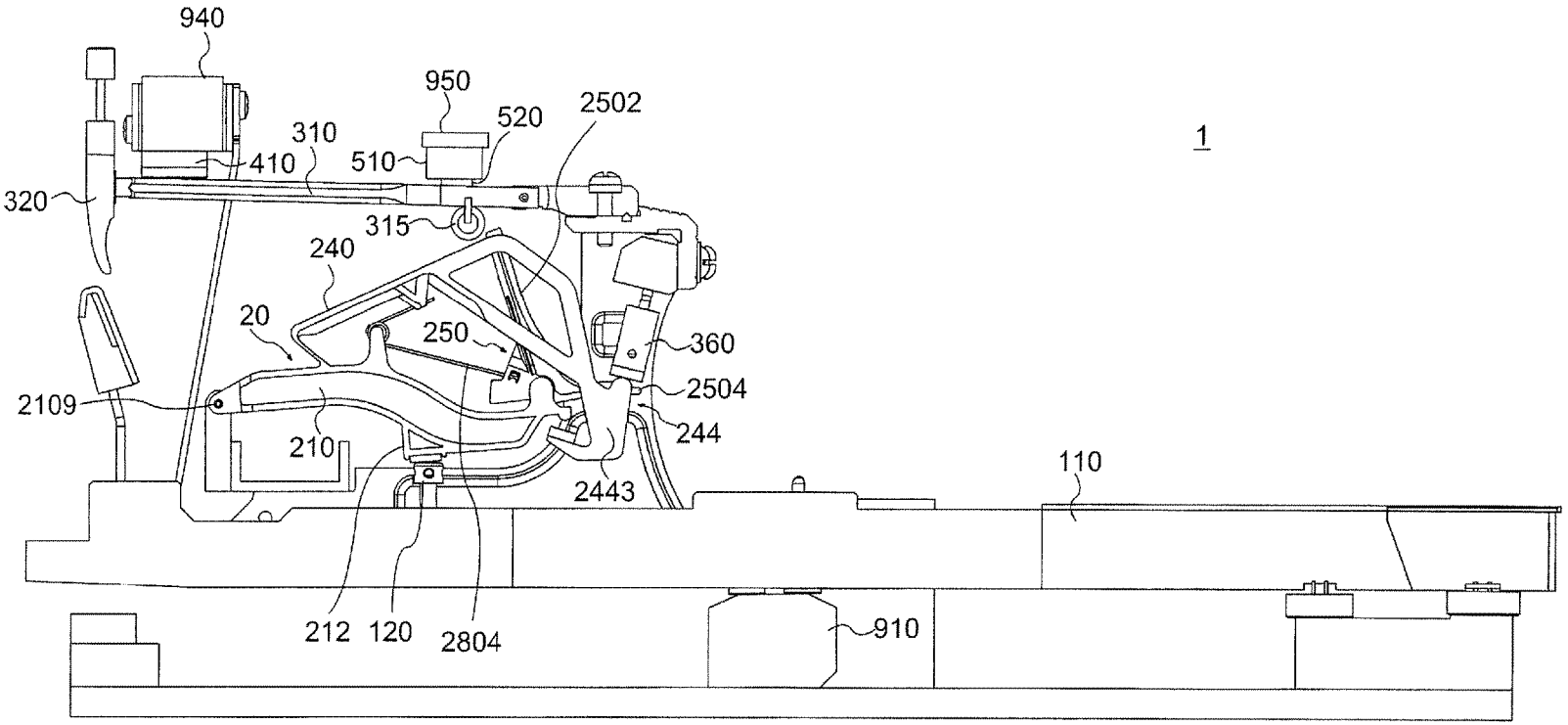
FIG. 4 is a side view for describing movement of the support assembly according to one embodiment of the present invention.

FIG. 4 is a side view for describing movement of the support assembly in one embodiment of the present invention. When the key 110 is pressed down to the end position, the capstan screw 120 pushes up the support heel 212 to rotate the support 210, with the axis of the through hole 2109 taken as a rotation center. When the support 210 rotates to move upward, the large jack 2502 pushes up the hammer roller 315 to cause the hammer shank 310 to collide with the hammer stopper 410. Note that this collision corresponds to string hammering by a hammer in a conventional grand piano.

Immediately before this collision, while upward movement of the small jack 2504 is regulated by the regulating button 360, the support 210 (jack support portion 2105) further ascends. Therefore, the large jack 2502 rotates so as to go off from the hammer roller 315. Here, by the regulating button 360, upward movement of the extending portion 244 is also regulated. In this example, the regulating button 360 has also a function of a repetition regulating screw in the action mechanism in a conventional grand piano.

Figure 5:
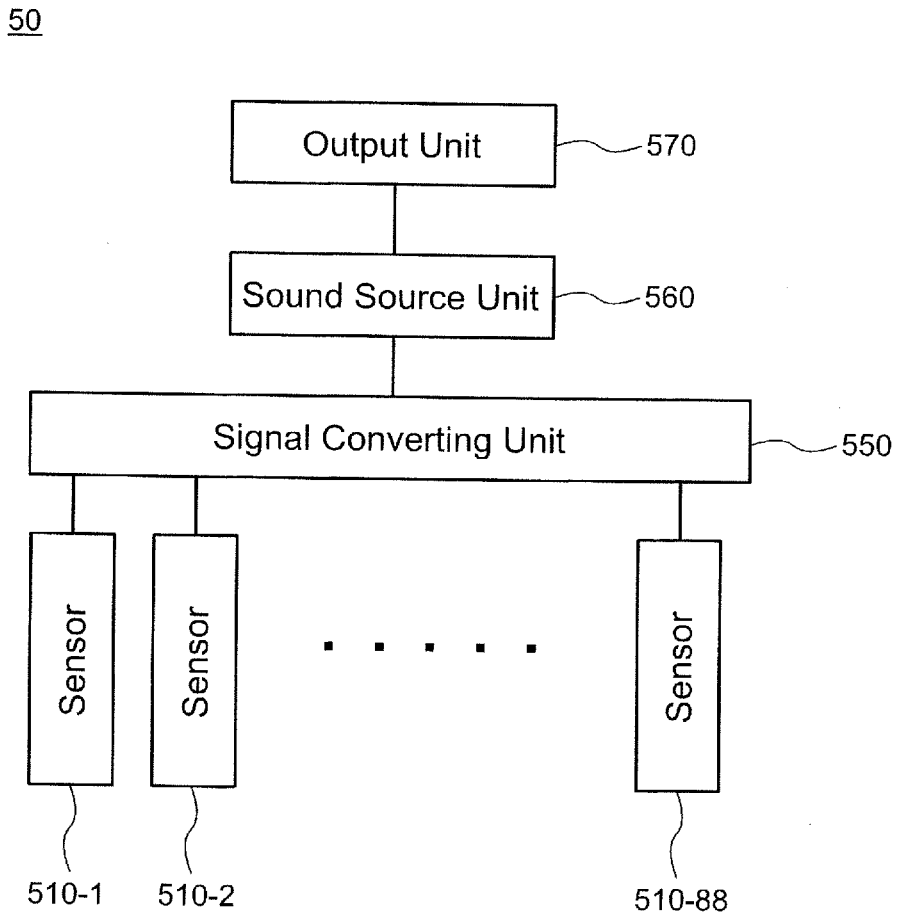
FIG. 5 is a block diagram depicting the structure of a sound emission mechanism of the keyboard apparatus according to one embodiment of the present invention.

This regulates upward movement of the repetition lever 240, which rotates so as to approach the support 210. With these operations, a double escapement mechanism is achieved. FIG. 5 is a drawing depicting this state. Note that when the key 110 is being returned to the rest position, the hammer roller 315 is supported by the repetition lever 240, and the large jack 2502 is returned below the hammer roller 315.

[Sound Emission Mechanism of Keyboard Apparatus 1]

As described above, the keyboard apparatus 1 is an example of application to an electronic piano. The operation of the key 110 is measured by the sensor 510, and a sound in accordance with the measurement result is outputted.

FIG. 5 is a block diagram depicting the structure of a sound emission mechanism of the keyboard apparatus according to one embodiment of the present invention. A sound emission mechanism 50 of the keyboard apparatus 1 includes the sensors 510 (sensors 510-1, 510-2, . . . 510-88 corresponding to the eighty-eight keys 110), a signal converting unit 550, a sound source unit 560, and an output unit 570. The signal converting unit 550 obtains an electric signal outputted from the sensor 510, and generates and outputs an operation signal in accordance with an operating state in each key 110. In this example, the operation signal is a MIDI-format signal. Therefore, in accordance with the timing when the hammer shank 310 collides with the hammer stopper 410 by key-pressing operation, the signal converting unit 550 outputs Note ON. Here, a key number indicating which of the eighty-eight keys 110 has been operated and velocity corresponding to a speed immediately before the collision are also outputted in association with Note ON. On the other hand, when key-releasing operation is performed, in accordance with the timing when string vibrations are stopped by a damper in the case of a grand piano, the signal converting unit 550 outputs the key number and Note OFF in association with each other. To the signal converting unit 550, a signal corresponding to another operation such as one on a pedal may be inputted and reflected to the operation signal. The sound source unit 560 generates a sound signal based on the operation signal outputted from the signal converting unit 550. The output unit 570 is a loudspeaker or terminal which outputs the sound signal generated by the sound source unit 560.

According to one embodiment of the present invention, compared with a keyboard apparatus of an acoustic piano, manufacturing cost of the support assembly can be reduced while changes in touch feeling at the time of key operation are decreased.

Second Embodiment

Figure 6B:
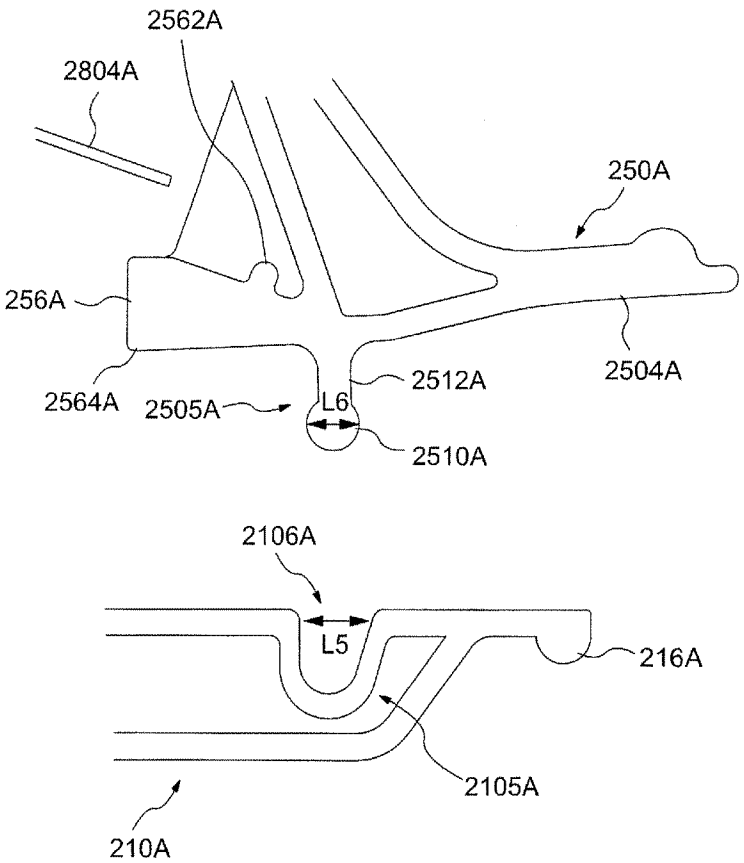
FIG. 6B is a disassembled view of the enlarged side view of the jack support portion in the support assembly according to one embodiment of the present invention.
Figure 6A:
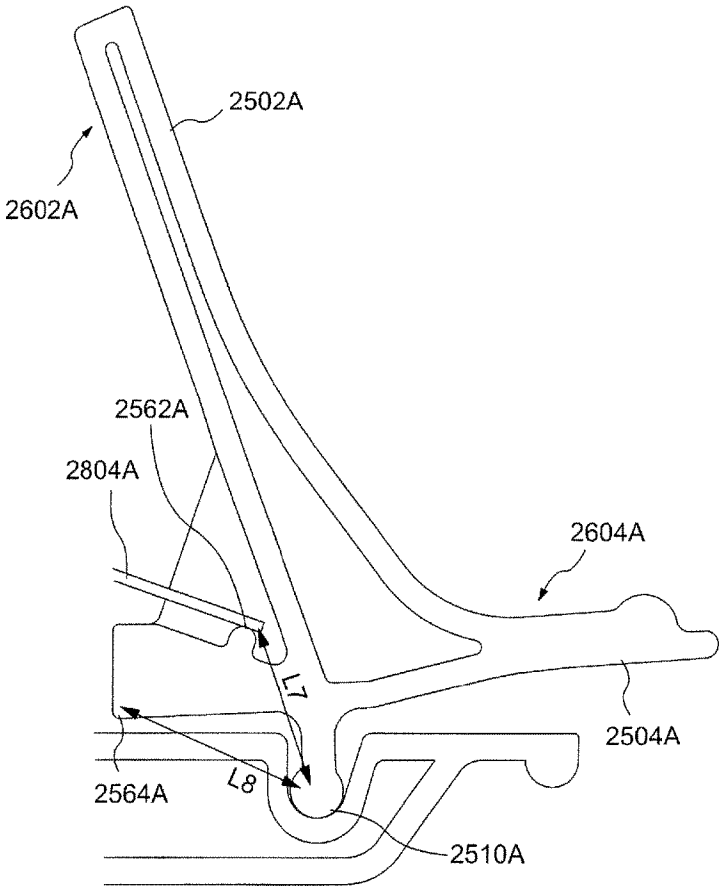
FIG. 6A is an enlarged side view of a jack support portion in a support assembly according to one embodiment of the present invention.

A jack support portion 2105A of a support 210A and a support connecting portion 2505A of a jack 250A for use in a keyboard apparatus 1A according to a second embodiment of the present invention are described by using FIG. 6A and FIG. 6B. FIG. 6A is an enlarged side view of the jack support portion in a support assembly according to one embodiment of the present invention. FIG. 6B is a disassembled view of the enlarged side view of the jack support portion in the support assembly according to one embodiment of the present invention. Here, FIG. 6A is a side view when the support connecting portion 2505A engages with the jack support portion 2105A. FIG. 6B is a side view when the support connecting portion 2505A and a torsion coil spring 280A (only a second arm 2804A is depicted in FIG. 6A and FIG. 6B) are removed from the jack support portion 2105A. Note that a cover member and so forth disposed sideward of the jack 250A and the torsion coil spring 280A are omitted in the side views depicted in FIG. 6A and FIG. 6B for convenience of description. In the second embodiment, components other than the jack support portion 2105A and the support connecting portion 2505A are similar to those of the first embodiment, and therefore are not described herein.

[Structure of Jack Support Portion 2105A and Support Connecting Portion 2505A]

As depicted in FIG. 6A and FIG. 6B, the jack support portion 2105A is provided with a recessed portion 2106A recessed to a key 110 side on an upper surface (surface on a jack 250 side) of the support 210A. Also, the support connecting portion 2505A includes a jack rotation shaft 2510A and a coupling portion 2512A. The coupling portion 2512A couples the jack rotation shaft 2510A and the jack 250A. The jack rotation shaft 2510A has a lower end in an arc shape. On the other hand, the recessed portion 2106A has an arc shape on a lower surface portion of the recessed portion 2106A corresponding to the arc shape of the jack rotation shaft 2510A. The arc of the recessed portion 2106A has a radius of curvature larger than the radius of curvature of the jack rotation shaft 2510A. Here, when the lower end of the jack rotation shaft 2510A and the lower surface portion of the recessed portion 2106A each have not an arc shape but an oval shape or curved shape, the radiuses of curvature of both of these at a contact point of the jack rotation shaft 2510A and the lower surface portion of the recessed portion 2106A may be designed so as to satisfy the above-described conditions. As depicted in FIG. 6A, with the recessed portion 2106A engaging with the jack rotation shaft 2510A, the jack 250A rotates about the jack rotation shaft 2510A. In other words, it can be said that the jack 250 is rotatably connected to the support 210A, with the support connecting portion 2505A disposed inside the recessed portion 2106A.

Here, a width L5 near an open end of the recessed portion 2106A is larger than a width L6 of the jack rotation shaft 2510A. That is, when the jack 250A is removed from the support 210A, the jack rotation shaft 2510A does not catch the recessed portion 2106A, and therefore the support connecting portion 2505A can be smoothly removed from the jack support portion 2105A. While the structure is depicted in FIG. 6A and FIG. 6B in which the width L5 is larger than the width L6, the present embodiment is not restricted to this structure, and the width L5 may be smaller than the width L6. That is, when the jack 250A is removed from the support 210A, the support connecting portion 2505A may catch the jack support portion 2105A. In other words, the jack 250A may be connected to the support 210A in a snap-fit manner.

While the structure is illustrated in FIG. 6A and FIG. 6B in which the recessed portion 2106A has an open end with the width L5 in a radial direction of the jack rotation shaft 2510A (or longitudinal direction of the key 110) and the jack rotation shaft 2510A has a diameter with the width L6 in the above-mentioned radial direction, the present embodiment is not restricted to this structure. For example, the structure may be such that the recessed portion has an open end with the width L5 in a direction of the axis of the jack rotation shaft 2510A (or arrangement direction of the keys 110) and the jack rotation shaft 2510A has a diameter with the width L6 in the above-mentioned axial direction. The structure may also be such that the recessed portion 2106A has an open end with the width L5 in a radial direction and axial direction of the jack rotation shaft 2510A and the jack rotation shaft 2510A has a diameter with the width L6 in the radial direction and axial direction of the jack rotation shaft 2510A. That is, the open end of the recessed portion 2106A may have a circular shape, and the jack rotation shaft 2510A may have a globular shape. Here, the open end of the recessed portion 2106A may have an oval shape, and the jack rotation shaft 2510A may have a spheroid.

As depicted in FIG. 6A, a distance L8 between the jack rotation shaft 2510A and the jack rotation stopper 2564A is longer than a distance L7 between the jack rotation shaft 2510A and the spring contact portion 2562A. Here, the distance L7 may be a distance from the rotation center of the jack 250A to the spring contact portion 2562A, and the distance L8 may be a distance from the rotation center of the jack 250A to the jack rotation stopper 2564A. In other words, it can be said that the jack rotation stopper 2564A is provided at a position at a distance from the rotation center of the jack 250A farther than a distance of the spring contact portion 2562A therefrom. With the above-described structure, the jack 250A is rotated by a downward action received by the spring contact portion 2562A from the second arm 2804A to cause the jack rotation stopper 2564A to make contact with the support 210A. In this state, the jack 250A presses the jack rotation shaft 2510A downward by the recessed portion 2106A. Note that when the rotation stopper of the jack 250A is provided to a deeper side from a player of the large jack 2502A or above the small jack 2504A, even with the stopper making contact with another member, the jack 250A presses the jack rotation shaft 2510A downward by the recessed portion 2106A. In this manner, the recessed portion 2106A engages with the jack rotation shaft 2510A.

Also in the second embodiment, the jack rotation stopper 260 as depicted in FIG. 3C may be provided to the jack 250A. Furthermore, in place of the jack rotation stopper 260, as with the first embodiment, the large jack 2502 or the small jack 2504 may function as a rotation stopper of the jack 250.

As described above, according to the keyboard apparatus 1A of the second embodiment of the present invention, the number of components configuring the support assembly can be decreased while the operation of the support assembly is ensured equivalently to conventional ones. Therefore, double escapement can be achieved in a simpler structure compared with the support assembly for use in general grand pianos, and thus the manufacturing cost can be reduced while an influence on touch feeling is decreased.

Also, with the recessed portion 2106A engaging with the jack rotation shaft 2510A, the jack 250A is attached to the support 210A, and the support assembly 20A is assembled easily. Furthermore, with the jack 250A pressed downward, the jack 250A is inhibited from being detached from the support 210A. Still further, since the width L5 of the open end of the recessed portion 2106A is larger than the width L6 of the jack rotation shaft 2510A, attachment and removal of the jack 250A to and from the support 210A are further facilitated.

With the projecting portion 256A provided to the jack, flexibility of designing the spring contact portion 2562A and the jack rotation stopper 2564A is improved. Also, with the jack rotation stopper 2564A provided to the jack 250A, the rotation range of the jack 250A is regulated, and stable operation of the support assembly 20A can be obtained. Furthermore, the distance between the jack rotation stopper 2564A and the rotation center of the jack 250A is longer than the distance between the spring contact portion 2562A and the rotation center of the jack 250A. With this, even if the rotation of the jack 250A is regulated by the jack rotation stopper 2564A, the rotation center of the jack 250A is inhibited from moving from the jack rotation shaft 2510A to another place. That is, even in the above-described state, the upper surface of the recessed portion 2106A presses the jack rotation shaft 2510A downward, and therefore the jack 250A is prevented from being detached from the support 210A.

Third Embodiment

Structure of Keyboard Apparatus 1B

As with the keyboard apparatus 1 of the first embodiment, a keyboard apparatus 1B in the third embodiment of the present invention is an example obtained by applying one example of the support assembly according to the present invention to an electronic piano. The keyboard apparatus 1B is similar to the keyboard apparatus 1, but is different therefrom in the support assembly and the support structure of the support assembly. Also, the keyboard apparatus 1B is different from the keyboard apparatus 1 in the method of regulating upward rotation of a repetition lever provided to the support assembly. In the following description, the above-mentioned differences are mainly described, and common portions are not described.

Figure 7:
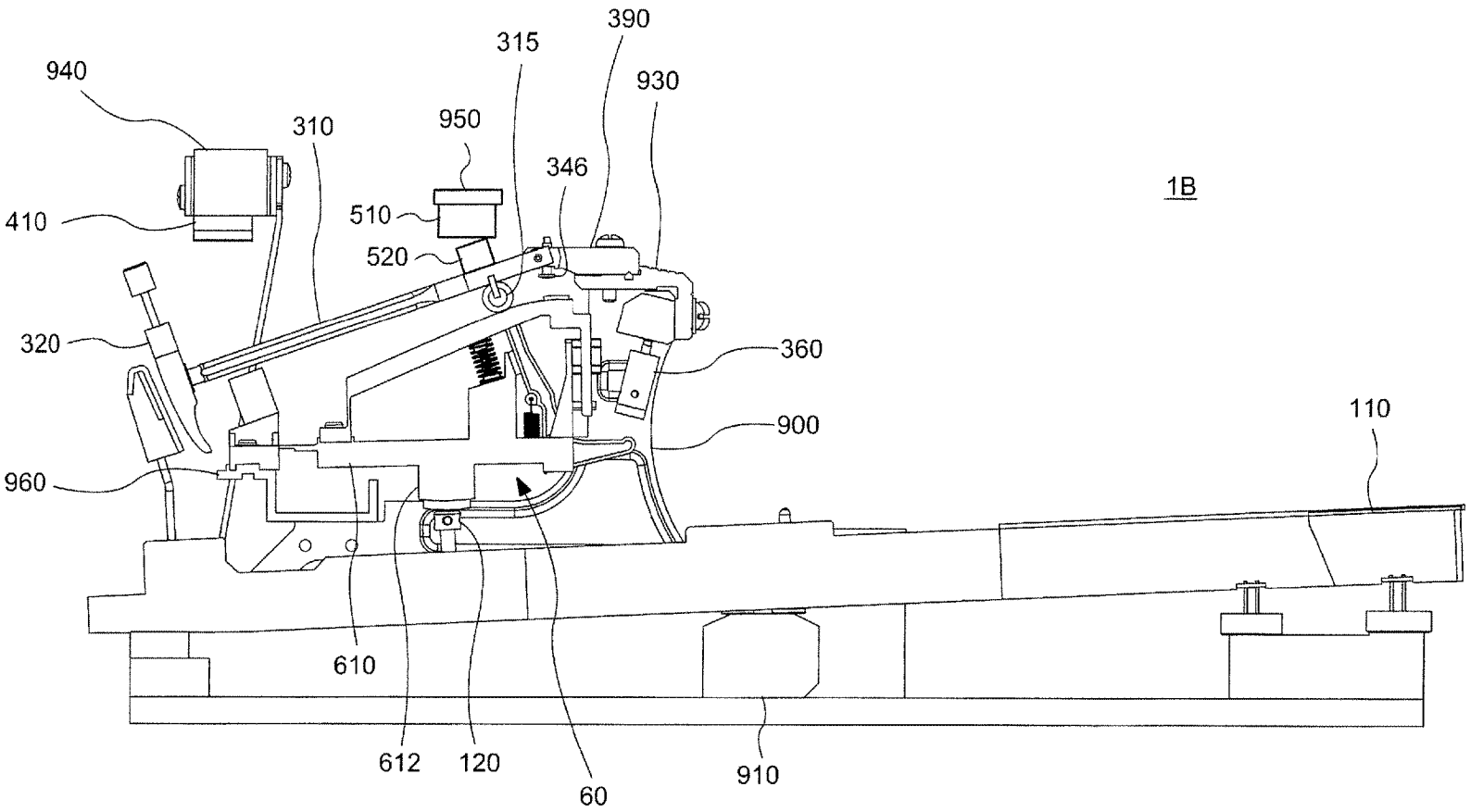
FIG. 7 is a side view depicting the structure of a keyboard apparatus according to one embodiment of the present invention.

FIG. 7 is a side view depicting the structure of a keyboard apparatus according to one embodiment of the present invention. A support assembly 60 is fixed to a support rail 960. The support rail 960 is supported by the bracket 900. The support assembly 20 in the first embodiment is rotatably supported with the shaft supported by the support flange 290 penetrating through the through hole 2109. On the other hand, while the support assembly 60 is similar to the support assembly 20 in that a support 610 is rotatably supported by the support rail 960, the supporting method is different, as will be described further below. A repetition regulating screw 346 regulates upward rotation (hammer shank 310 side) of the support assembly 60. Note that the support rail 960 is an example of a frame serving as a reference of rotation of the support assembly 60. The frame may be formed of one member, such as the support rail 960, or may be formed of a plurality of members. The frame may be, as with the support rail 960, a rail-shaped member with a long side in the arrangement direction of the keys 110, or may be an independent member for each key 110.

[Structure of Support Assembly 60]

Figure 8:
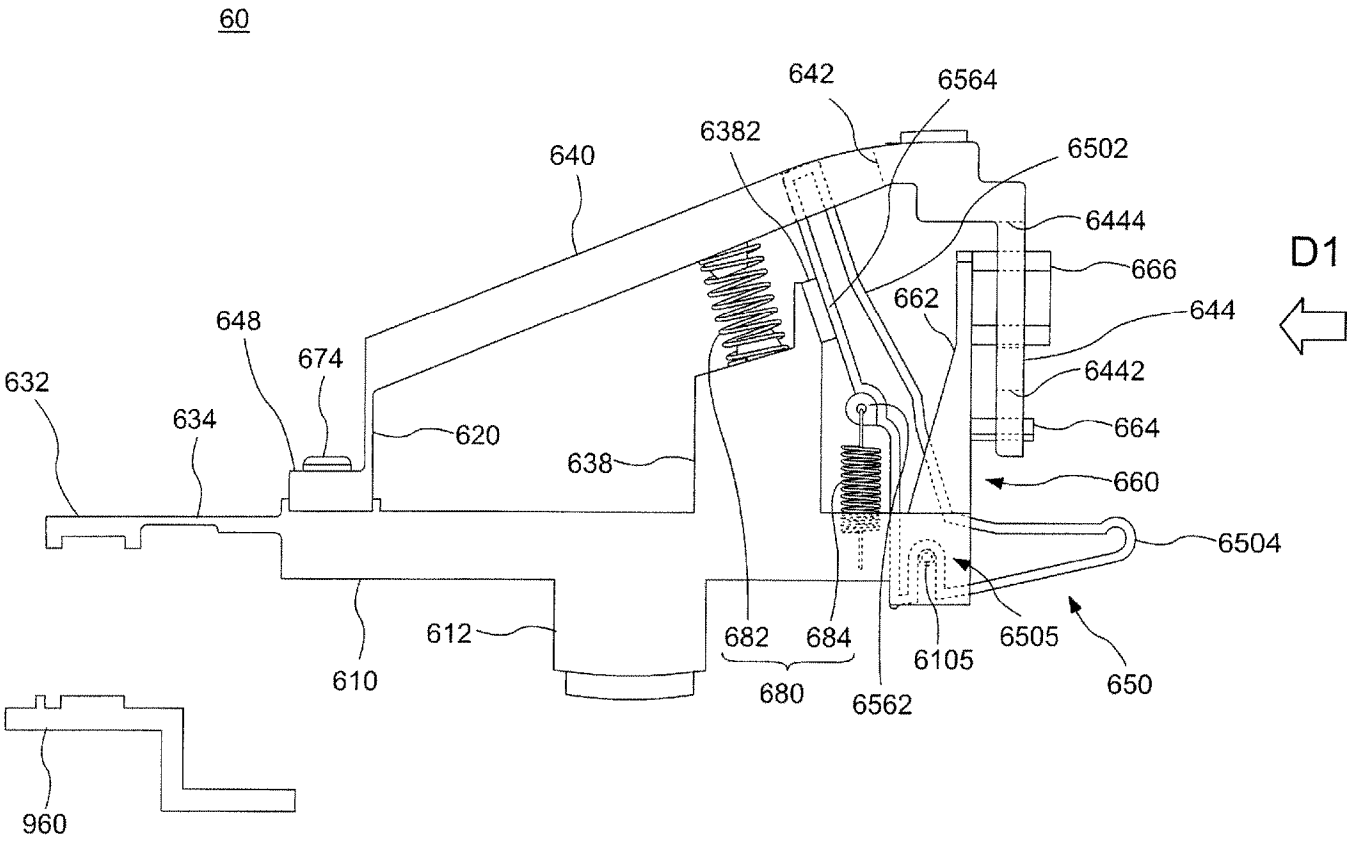
FIG. 8 is a side view depicting the structure of a support assembly according to one embodiment of the present invention.

FIG. 8 is a side view depicting the structure of the support assembly according to one embodiment of the present invention. The support assembly 60 of the keyboard apparatus 1B includes the support 610, a repetition lever 640, a jack 650, an operation regulating portion 660, and a coil spring 680. The support assembly 60, except the coil spring 680 and cushioning materials or the like (such as nonwoven fabric or elastic body) provided at a portion which collides with another member, is a resin-made structure manufactured by injection molding.

The support 610 is rotatably supported with respect to the support rail 960. The repetition lever 640 is rotatably supported to the support 610. The jack 650 is rotatably disposed to the support 610. Also, the jack 650 has a large jack 6502 and a small jack 6504. The large jack 6502 is disposed so as to be able to penetrate through a slit 642 provided in the repetition lever 640. The small jack 6504 extends from the support 610 to a forward side from a player. The operation regulating portion 660 is disposed on a repetition lever 640 side of the support 610.

Also, the support 610 includes a support heel 612, a frame fixing portion 632, a flexible portion 634, and a mount 638. The frame fixing portion 632 fixes the support 610 to the support rail 960. The flexible portion 634 is provided between the support 610 and the frame fixing portion 632 of each support assembly 60, and has flexibility (elasticity). Also, the flexible portion 634 is integrally formed with the support 610 and the frame fixing portion 632. In a rotating direction of the support assembly 60 or a plate-thickness direction of the flexibly portion 634, the flexible portion 634 is thinner than at least the support 610. Note that while the structure is illustrated in FIG. 8 in which the support 610, the frame fixing portion 632, and the flexible portion 634 are integrally formed, the present embodiment is not restricted to this structure. For example, the flexible portion 634 may be fixed to one or both of the support 610 and the frame fixing portion 632 by a fixture, adhesive, welding, or the like. Here, the flexible portion 634 serves as a rotation center of the support assembly 60.

The mount 638 is connected to a repetition lever 640 side of the support 610. On an upper surface (repetition lever 640 side) of the mount 638, a coil spring 682 acting on the mount 638 and the repetition lever 640 and a large-jack stopper 6382 regulating rotation of the jack 650 in a direction in which the large jack 6502 approaches the mount 638 are provided. Here, part of the large jack 6502 abutting on the large-jack stopper 6382 can be said as a jack rotation stopper 6564. The coil spring 682 is a compression spring which acts on the mount 638 and the repetition lever 640 in a direction in which the mount 638 and the repetition lever 640 go away from each other and functions as an elastic body providing a rotational force to the repetition lever 640. Between the large-jack stopper 6382 and the large jack 6502, cushioning materials or the like (such as nonwoven fabric or elastic body) may be provided for reducing noise occurring due to a contact between the large-jack stopper 6382 and the large jack 6502.

The repetition lever 640 has a flexible portion 620, the slit 642, an extension portion 644, and a support fixing portion 648.

The flexible portion 620 extends to a support 610 side of the repetition lever 640 to be coupled to the support fixing portion 648. That is, the flexible portion 620 is provided between the repetition lever 640 and the support fixing portion 648. The flexible portion 620 is integrally formed with the support fixing portion 648 and the repetition lever 640. Since the plate thickness of the flexible portion 620 is thinner than the plate thickness of the repetition lever 640, the flexible portion 620 has flexibility (elasticity). Therefore, the repetition lever 640 rotates about the flexible portion 620.

The slit 642 is provided at a position through which the large jack 6502 can penetrate, on part of a forward side from a player of the flexible portion 620 as a rotation center of the repetition lever 640. The extension portion 644 is coupled to a support 610 side of the repetition lever 640 on a jack 650 side from the flexible portion 620 as the rotation center of the repetition lever 640. Also, the extension portion 644 has slits 6442 and 6444. The support fixing portion 648 is fixed to the support 610 by a fixture 674.

Note that while the structure is illustrated in FIG. 8 in which the repetition lever 640, the flexible portion 620, and the support fixing portion 648 are integrally formed, the present embodiment is not restricted to this structure. For example, the flexible portion 620 may be fixed to one or both of the repetition lever 640 and the support fixing portion 648 by a fixture, adhesive, welding, or the like.

With a support connecting portion 6505 between the large jack 6502 and the small jack 6504 connected to a jack support portion 6105, the jack 650 is rotatably disposed with respect to the support 610. Part of the large jack 6502 is provided with a spring contact portion 6562 to which a coil spring 684 is connected. The coil spring 684 is a tension spring which acts on the large jack 6502 and the support 610 in a direction in which the large jack 6502 approaches the mount 638 and functions as an elastic body providing a rotational force to the jack 650.

On a forward side from a player from the mount 638, the support 610 includes two plate-shaped members which interpose the jack support 6105 from sides of both side surfaces. Between these plate-shaped members, the support connecting portion 6505 and part of the coil spring 684 are provided. To inhibit yawing and rolling of the jack 650, in at least part of a space interposed between these two plated-shaped members, the jack 650 and the support 610 may slidably contact with each other.

The operation regulating portion 660 is provided opposite to the flexible portion 634 with reference to the flexible portion 620. Also, the operation regulating portion 660 has an extension portion 662, a stopper 664, and a guide 666. The extension portion 662 is disposed on a repetition lever 640 side of the support 610. The stopper 664 and the guide 666 are disposed to the extension portion 662, and each extends from the extension portion 662 to a forward side from a player. In other words, it can be said that the stopper 664 and the guide 666 are projecting portions projecting from the extension portion 662 to a forward side from a player. The stopper 664 penetrates through the slit 6442 provided in the extension portion 644, and the guide 666 penetrates through the slit 6444 provided in the extension portion 644. Note that the slits 6442 and 6444 may have any shape as long as the stopper 664 and the guide 666 can engage and, for example, may have a shape provided with a groove with which the stopper 664 and the guide 666 can engage. The slits 6442 and the 6444 can be said as engaging portions.

[Structure of Jack Support Portion 6105 and Support Connecting Portion 6505]

Figure 9B:
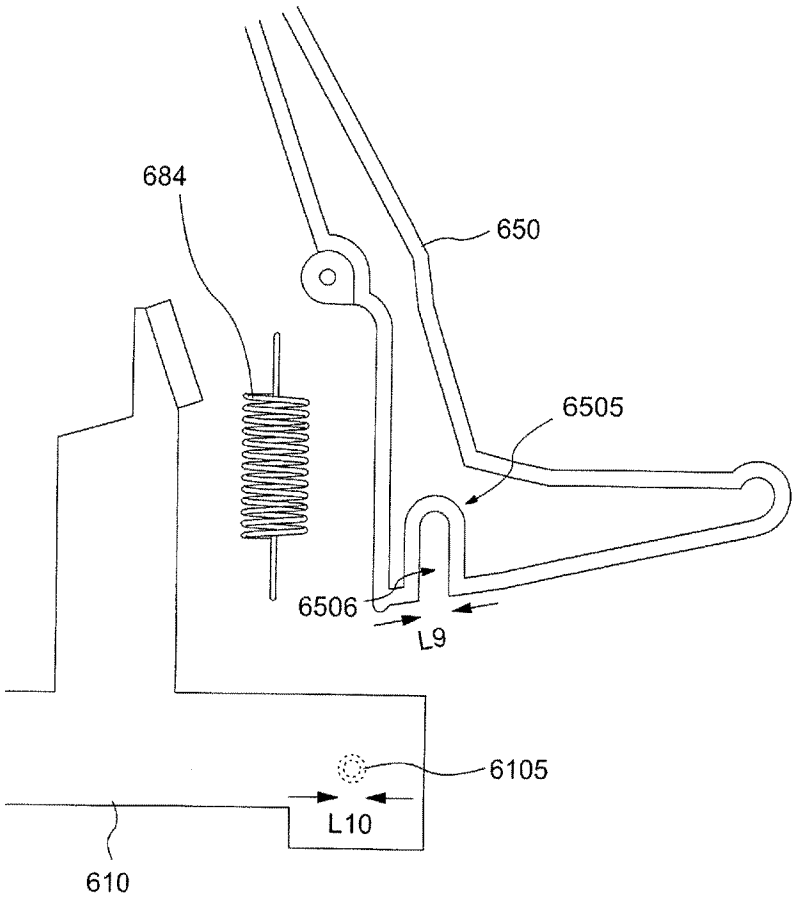
FIG. 9B is a disassembled view of the enlarged side view of the jack support portion in the support assembly according to one embodiment of the present invention.
Figure 9A:
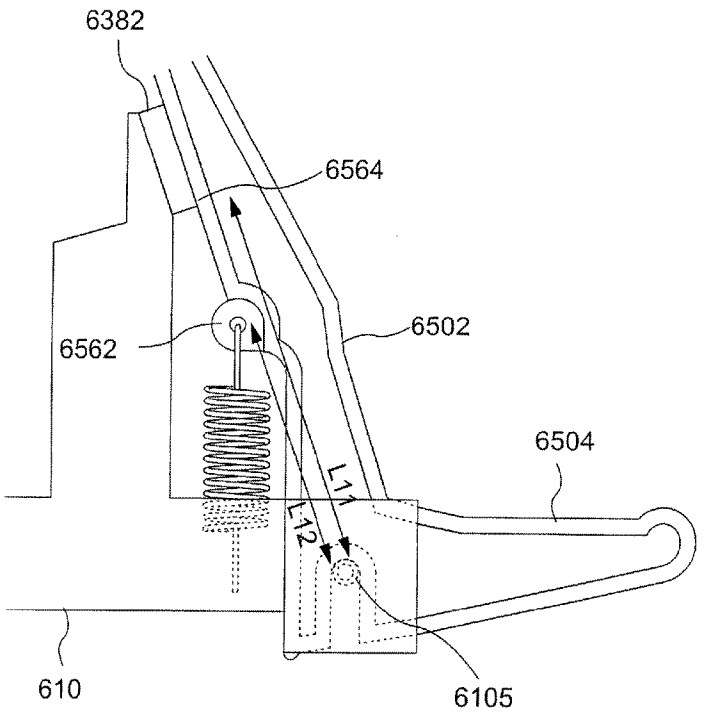
FIG. 9A is an enlarged side view of a jack support portion in the support assembly according to one embodiment of the present invention.

The structure of the jack support portion 6105 and the support connecting portion 6505 is described in detail by using FIG. 9A and FIG. 9B. FIG. 9A is an enlarged side view of the jack support portion in the support assembly according to one embodiment of the present invention. FIG. 9B is a disassembled view of the enlarged side view of the jack support portion in the support assembly according to one embodiment of the present invention. Here, FIG. 9A is a side view when the support connecting portion 6505 engages with the jack support portion 6105. FIG. 9B is a side view when the support connecting portion 6505 and the coil spring 684 are removed from the jack support portion 6105.

As depicted in FIG. 9A and FIG. 9B, the jack support portion 6105 is interposed between the two plate-shaped members of the support 610, and has a stick-like shape with a long side sideway. The sectional shape of the jack support portion 6105 is a circular shape. A recessed portion 6506 provided to the support connecting section 6505 has an arc shape on its upper surface portion corresponding to the circular shape of the jack support portion 6105. The arc of the recessed portion 2106 has a radius of curvature larger than the radius of curvature of the jack support portion 6105. Here, when the jack support portion 6105 does not have a circular shape or the upper surface portion of the recessed portion 6506 has not an arc shape but an oval shape or curved shape, the radiuses of curvature of both of these at a contact point of the jack support portion 6105 and the upper surface portion of the recessed portion 6506 may be designed so as to satisfy the above-described conditions. As depicted in FIG. 9A, with the recessed portion 6506 engaging with the jack support portion 6105, the jack 650 rotates about the jack support portion 6105.

Here a width L9 near an open end of the recessed portion 6506 is larger than a width L10 of the jack support portion 6105. That is, when the jack 650 is removed from the support 610, the recessed portion 6506 does not catch the jack support portion 6105, and therefore the support connecting portion 6505 can be smoothly removed from the jack support portion 6105. While the structure is illustrated in FIG. 9A and FIG. 9B in which the width L9 is larger than the width L10, the present embodiment is not restricted to this structure, and the width L9 may be smaller than the width L10. That is, when the jack 650 is removed from the support 610, the support connecting portion 6505 may catch the jack support portion 6105. In other words, the jack 650 may be connected to the support 610 in a snap-fit manner.

As depicted in FIG. 9A, a distance L11 between the jack support portion 6105 and the jack rotation stopper 6564 is longer than a distance L12 between the jack support portion 6105 and the spring contact portion 6562. Here, the distance L11 may be a distance from the rotation center of the jack 650 to the jack rotation stopper 6564, and the distance L12 may be a distance from the rotation center of the jack 650 to the spring contact portion 6562. In other words, it can be said that the jack rotation stopper 6564 is provided at a position at a distance from the rotation center of the jack 650 farther than a distance of the spring contact portion 6562 therefrom. With the above-described structure, the jack 650 is rotated by a downward action received by the spring contact portion 6562 from the coil spring 684 to cause the jack rotation stopper 6564 to make contact with the large-jack stopper 6382. In this state, the jack 650 presses the jack support portion 6105 downward by the recessed portion 6506.

Figure 10A:
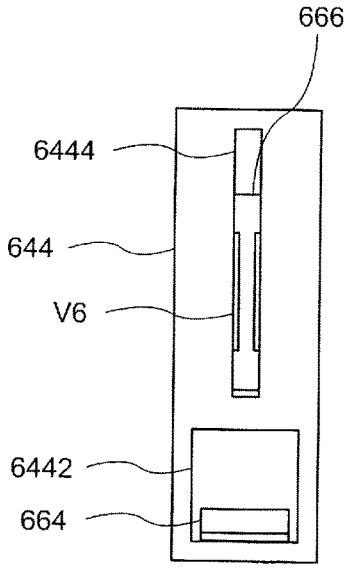
FIG. 10A is a side view of the structure of a stopper and a guide of the support assembly according to one embodiment of the present invention.
Figure 10B:
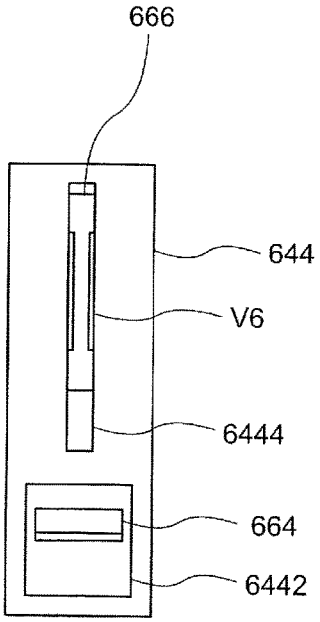
FIG. 10B is a side view of the structure of the stopper and the guide of the support assembly according to one embodiment of the present invention.

FIG. 10A and FIG. 10B are side views of the structure of the stopper and the guide of the support assembly according to one embodiment of the present invention. The side views depicted in FIG. 10A and FIG. 10B are drawings depicting only the extension portion 644, the stopper 664, and the guide 666 in the side view viewed along a D1 direction in FIG. 8. Also, FIG. 10A is a side view of a rest position, and FIG. 10B is a side view of an end position. The stopper 664 has a long side in a direction crossing the rotating direction of the repetition lever 640 and the extension portion 644. Also, the guide 666 and the slit 6444 have a long side in the rotating direction of the repetition lever 640 and the extension portion 644. The guide 666 has a groove V6 in an inner wall of the slit 6444 to decrease an area where the guide 666 and the slit 6444 slidably contact each other. The above-mentioned groove V6 may be coated with grease.

Here, at the rest position depicted in FIG. 8 and FIG. 10A, the extension portion 644 makes contact with the stopper 664 in the slit 6442 from a support 610 side (downward) of the stopper 664. In other words, the extension portion 644 makes contact with the operation regulating portion 660 from downward of the operation regulating portion 660. That is, the stopper 664 or the operation regulating portion 660 regulates rotation of the repetition lever 640 and the extension portion 644 to a hammer shank 310 side (upward). Between the extension portion 644 and the stopper 664, cushioning materials or the like (such as nonwoven fabric or elastic body) may be provided for reducing noise occurring due to a contact between the extension portion 644 and the stopper 664.

Also, the extension portion 644 makes contact with the guide 666 sideward in the slit 6444. Here, sideward means a direction in which the support assembly 60 is adjacent or an extension direction of the support rail 960. In other words, the extension portion 644 makes contact with the operation regulating portion 660 sideward. That is, the guide 666 or the operation regulating portion 660 inhibits yawing and rolling of the repetition lever 640. A portion between the extension portion 644 and the guide 666 may be coated with grease for smooth slidable movement of the extension portion 644 and the guide 666.

Note that while the structure is illustrated in FIG. 8, FIG. 10A, and FIG. 10B in which a slit is provided to the extension portion 644 connected to the repetition lever 640 and a projecting portion is provided to the extension portion 662 connected to the support 610, the present embodiment is not restricted to this structure. For example, the structure may be such that a slit is provided to the extension portion 662, and a projecting portion penetrating through the slit is provided to the extension portion 644.

As described above, according to the keyboard apparatus 1B of the third embodiment of the present invention, effects similar to those of the keyboard apparatus 1 of the first embodiment can be obtained.

[Operation of Support Assembly 60]

Next, the support assembly 60 is described when the key 110 is pressed down from the rest position (FIG. 7) to the end position.

Figure 11:
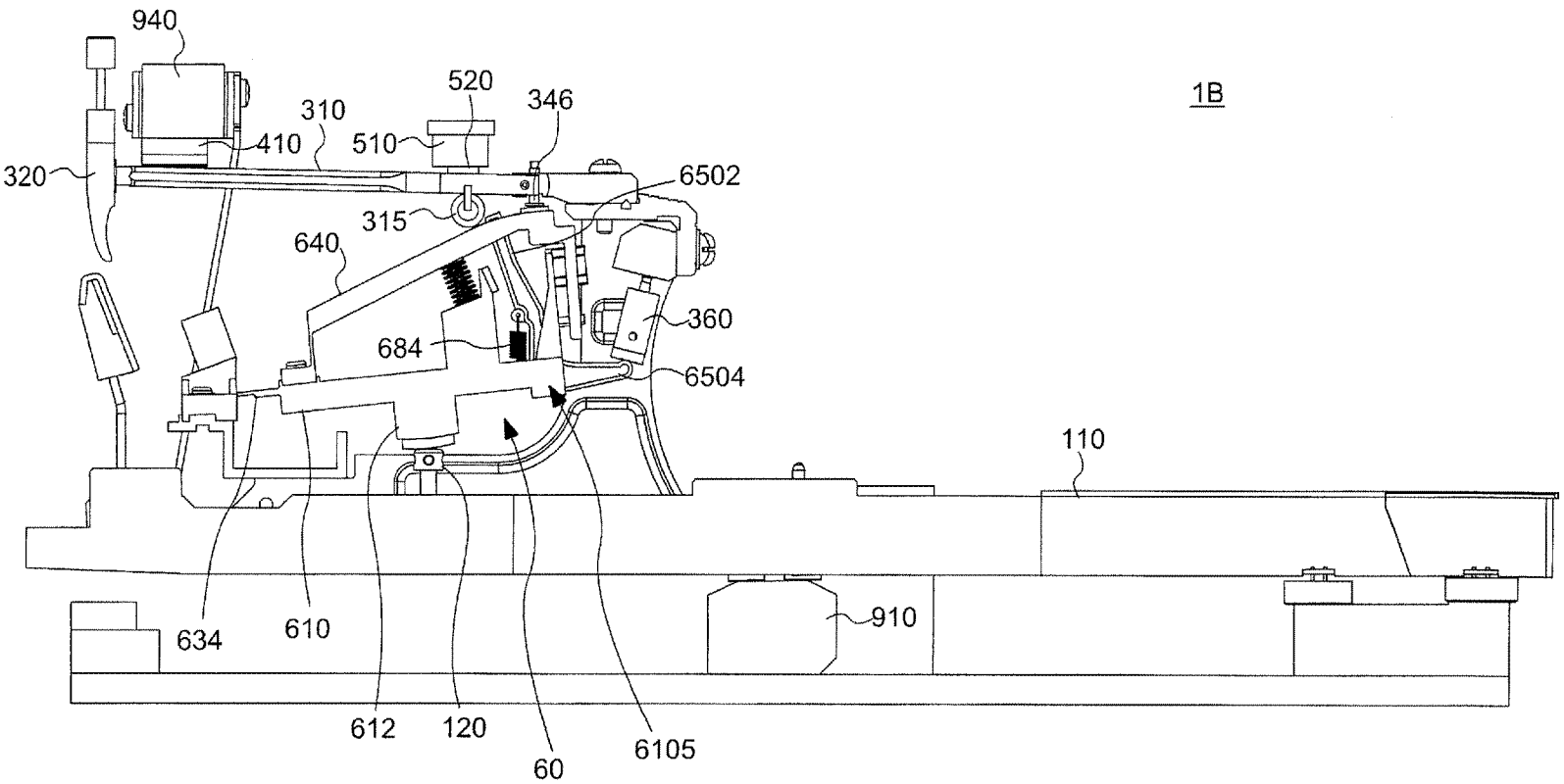
FIG. 11 is a side view for describing movement of the support assembly according to one embodiment of the present invention.

FIG. 11 is a side view for describing movement of the support assembly in one embodiment of the present invention. When the key 110 is pressed down to the end position, the capstan screw 120 pushes up the support heel 612 to rotate the support 610, with the axis of the flexible portion 634 taken as a rotation center. When the support 610 rotates to move upward, the large jack 6502 pushes up the hammer roller 315 to cause the hammer shank 310 to collide with the hammer stopper 410.

Immediately before this collision, while upward movement of the small jack 6504 is regulated by the regulating button 360, the support 610 (jack support portion 6105) further ascends. Therefore, the large jack 6502 rotates so as to go off from the hammer roller 315. Here, by the repetition regulating screw 346, upward movement of the repetition lever 640 is regulated. This regulates upward movement of the repetition lever 640, which rotates so as to approach the support 610. With these operations, a double escapement mechanism is achieved. FIG. 11 is a drawing depicting this state. Note that when the key 110 is being returned to the rest position, the hammer roller 315 is supported by the repetition lever 640, and the large jack 6502 is returned below the hammer roller 315.

Fourth Embodiment

Figure 12B:
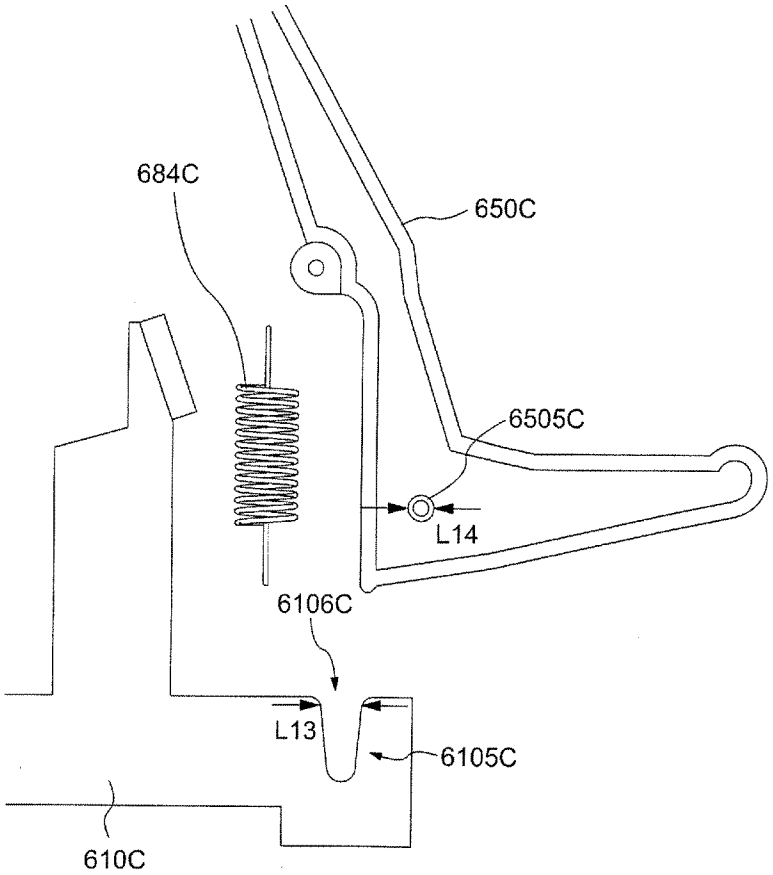
FIG. 12B is a disassembled view of the enlarged side view of the jack support portion in the support assembly according to one embodiment of the present invention.
Figure 12A:
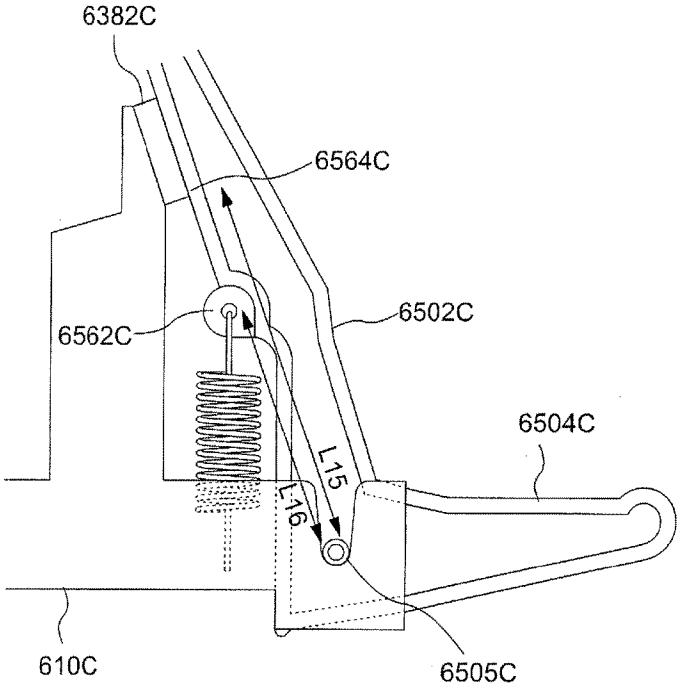
FIG. 12A is an enlarged side view of a jack support portion in the support assembly according to one embodiment of the present invention.

A jack support portion 6105C of a support 610C and a support connecting portion 6505C of a jack 650C for use in a keyboard apparatus 1C according to a fourth embodiment of the present invention are described by using FIG. 12A and FIG. 12B. FIG. 12A is an enlarged side view of the jack support portion in the support assembly according to one embodiment of the present invention. FIG. 12B is a disassembled view of the enlarged side view of the jack support portion in the support assembly according to one embodiment of the present invention. Here, FIG. 12A is a side view when the support connecting portion 6505C engages with the jack support portion 6105C. FIG. 12B is a side view when the support connecting portion 6505C and a coil spring 684C are removed from the jack support portion 6105C. In the fourth embodiment, components other than the jack support portion 6105C and the support connecting portion 6505C are similar to those of the first embodiment, and therefore are not described herein.

[Structure of Jack Support Portion 6105C and Support Connecting Portion 6505C]

As depicted in FIG. 12A and FIG. 12B, the jack support portion 6105C is provided with a recessed portion 6106C recessed to a key 110 side on an upper surface (surface on a jack 250C side) of the support 610C. The recessed portion 6106C is provided to both of two plate-shaped members of the support 610C. Also, the support connecting portion 6505C projects to both sides from the jack 650C near a coupling portion between a large jack 6502C and a small jack 6504C. The sectional shape of the support connecting portion 6505C is a circular shape. The recessed portion 6106C has an arc shape on a lower surface portion corresponding to the circular shape of the support connecting portion 6505C. The arc of the recessed portion 6106C has a radius of curvature larger than the radius of curvature of the circle of the support connecting portion 6505C. Here, when the support connecting portion 6505 does not have a circular shape or the lower surface portion of the recessed portion 6106C has not an arc shape but an oval shape or curved shape, the radiuses of curvature of both of these at a contact point of the support connecting portion 6505C and the lower surface portion of the recessed portion 6506C may be designed so as to satisfy the above-described conditions. As depicted in FIG. 12A, with the recessed portion 6106C engaging with the support connecting portion 6505C, the jack 650C rotates about the support connecting portion 6505C.

Here, a width L13 near an open end of the recessed portion 6106C is larger than a width L14 of the support connecting portion 6505C. That is, when the jack 650C is removed from the support 610C, the support connecting portion 6505C does not catch the recessed portion 6106C, and therefore the support connecting portion 6505C can be smoothly removed from the jack support portion 6105C. While the structure is illustrated in FIG. 12A and FIG. 12B in which the width L13 is larger than the width L14, the present embodiment is not restricted to this structure, and the width L13 may be smaller than the width L14. That is, when the jack 650C is removed from the support 610C, the support connecting portion 6505C may catch the jack support portion 6105C. In other words, the jack 650C may be connected to the support 610C in a snap-fit manner.

As depicted in FIG. 12A, a distance L15 between the support connecting portion 6505C and the jack rotation stopper 6564C is longer than a distance L16 between the support connecting portion 6505C and the spring contact portion 6562C. Here, the distance L15 may be a distance from the rotation center of the jack 650C to the jack rotation stopper 6564C, and the distance L16 may be a distance from the rotation center of the jack 650C to the spring contact portion 6562C. In other words, it can be said that the jack rotation stopper 6564C is provided at a position at a distance from the rotation center of the jack 650C farther than a distance of the spring contact portion 6562C therefrom. With the above-described structure, the jack 650C is rotated by a downward action received by the spring contact portion 6562C from the coil spring 684C to cause the jack rotation stopper 6564C to make contact with a large-jack stopper 6382C. In this state, the jack 650C presses the jack support portion 6105C downward by the recessed portion 6506.

As described above, according to the keyboard apparatus 1C of the fourth embodiment of the present invention, effects similar to those of the keyboard apparatus 1A of the second embodiment can be obtained.

In the above-described embodiment, an electronic piano is described as an example of a keyboard apparatus to which a support assembly is applied. On the other hand, the support assembly of the above-described embodiment can be applied to a grand piano (acoustic piano). In this case, the sound emission mechanism corresponds to a hammer and a string. The string generates a sound by colliding a hammer in accordance with key pressing. In the case the large jack 2502 is returned below the hammer roller 315 after string hammering by the hammer, the repetition lever 240 may be omitted. For example, the keyboard apparatus 1 may have a structure whereby when the key 110 is returned to the rest position a part of the hammer assembly is supported by another member instead of the repetition lever 240 and the large jack 2502 is returned below the hammer roller 315.

The present invention is not restricted to the above-described embodiments but can be modified as appropriate in a scope not deviating from the gist of the present invention.

The invention claimed is:

1. A support assembly comprising:

a support rotatably disposed with respect to a frame;

a jack support portion connected to the support;

a jack having a recessed portion in a lower portion of the jack, the jack having the jack support portion inside the recessed portion and being rotatably disposed to the support; and an acting portion fixed to the jack and receiving a downward action.

2. The support assembly according to claim 1, wherein the recessed portion has an open end with a width larger than a width of the jack support portion.

3. The support assembly according to claim 1, further comprising a jack pressing portion being contact with the acting portion from above to press the jack downward.

4. The support assembly according to claim 3, wherein the jack pressing portion is an elastic member connected to the support.

5. The support assembly according to claim 3, wherein the jack includes a projecting portion projecting from the jack, and the acting portion is provided to the projecting portion.

6. The support assembly according to claim 3, wherein the jack pressing portion provides a rotating action of the jack to the acting portion.

7. The support assembly according to claim 6, wherein the jack has a stopper regulating a rotation range of the jack with respect to the rotating action.

8. The support assembly according to claim 7, wherein the jack has a large jack projecting upward, a projecting portion projecting from the large jack and a small jack projecting in a direction opposite to the projecting portion, and the stopper regulates the rotation range of the jack by abutting on another member on a deeper side from a player of the large jack, above the small jack, or below the projecting portion and a distance from a rotation center of the jack to a position where the stopper abuts on the other member is farther than a distance from the rotation center of the jack to the acting portion.

9. A support assembly comprising:

a support rotatably disposed with respect to a frame and having a recessed portion in an upper portion of the support;

a jack rotatably disposed to the support;

a support connecting portion fixed to the jack, the support connecting portion being disposed inside the recessed portion and including a rotation center of the jack; and an acting portion fixed to the jack and receiving a downward action.

10. The support assembly according to claim 9, wherein the recessed portion has an open end with a width larger than a width of the support connecting portion.

11. The support assembly according to claim 9, further comprising a jack pressing portion being contact with the acting portion from above to press the jack downward.

12. The support assembly according to claim 11, wherein the jack pressing portion is an elastic member connected to the support.

13. The support assembly according to claim 11, wherein the jack includes a projecting portion projecting from the jack, and the acting portion is provided to the projecting portion.

14. The support assembly according to claim 11, wherein the jack pressing portion provides a rotating action of the jack to the acting portion.

15. The support assembly according to claim 14, wherein the jack has a stopper regulating a rotation range of the jack with respect to the rotating action.

16. The support assembly according to claim 15, wherein the jack has a large jack projecting upward, a projecting portion projecting from the large jack and a small jack projecting in a direction opposite to the projecting portion, and the stopper regulates the rotation range of the jack by abutting on another member on a deeper side from a player of the large jack, above the small jack, or below the projecting portion and a distance from a rotation center of the jack to a position where the stopper abuts on the other member is farther than a distance from the rotation center of the jack to the acting portion.

17. A keyboard apparatus comprising:

a plurality of the support assemblies according to claim 1;

keys disposed correspondingly to the respective support assemblies to rotate the support; and a sound emission mechanism emitting sound in accordance with key pressing.

18. A keyboard apparatus comprising:

a plurality of the support assemblies according to claim 9;

keys disposed correspondingly to the respective support assemblies to rotate the support; and a sound emission mechanism emitting sound in accordance with key pressing.

* * * * *